US005743226A

United States Patent [19]

Tohdoh et al.

[11] Patent Number: 5,743,226

[45] Date of Patent: Apr. 28, 1998

[54] VALVE LIFTER

[75] Inventors: Tamotsu Tohdoh; Yasuo Fukuda, both of Atsugi; Hiroaki Kawakami, Sagamihara, all of Japan

[73] Assignee: Unisia Jecs Corporation, Atsugi, Japan

[21] Appl. No.: 897,023

[22] Filed: Jul. 18, 1997

Related U.S. Application Data

[63] Continuation of Ser. No. 549,158, Oct. 27, 1995, abandoned.

[30] Foreign Application Priority Data

Oct. 27, 1994 [JP] Japan ..... 6-263338
Apr. 11, 1995 [JP] Japan ..... 7-085101

[51] Int. Cl.[6] ..... F01L 13/00

[52] U.S. Cl. ..... 123/90.16; 123/90.5

[58] Field of Search ..... 123/90.15, 90.16, 123/90.17, 90.48, 90.49, 90.5; 74/569

[56] References Cited

U.S. PATENT DOCUMENTS 5,343,833 9/1994 Shirai ..... 123/90.16
5,351,662 10/1994 Dopson et al. ..... 123/90.16
5,431,133 7/1995 Spath et al. ..... 123/90.16

FOREIGN PATENT DOCUMENTS 63-117109 5/1988 Japan .
91/12413 8/1991 WIPO .
93/18284 9/1993 WIPO .

*Primary Examiner*—Weilun Lo
*Attorney, Agent, or Firm*—Foley & Lardner

[57] ABSTRACT

A valve lifter has a lifter body with a first surface arranged to feet on a pair of low lift cams on a camshaft, and a pair of hydraulic slides disposed in a bore of the lifter body. The slides have a stored position wherein they define therebetween and within the bore a chamber arranged to allow entry of a high lift cam on the camshaft disposed between the pair of low lift cams. The lifter body is formed with a window opening to the chamber to allow access of the high lift cam to the chamber. The slides have an operative position wherein they define a second surface opposite to the window arranged to rest on the high lift cam.

25 Claims, 14 Drawing Sheets

10
12
14
16
18
20
22
24
26
28
30
32
34
36
38
40
42
44
46
48
50
52
54
56
58
60
70
72
76
78
80
82
84
86
88
90
92
94
96
98
100
120

VALVE LIFTER

This application is a continuation of application Ser. No. 08/549/158, filed Oct. 27, 1995, now abandoned.

BACKGROUND OF THE INVENTION

The present invention relates to valve lifters and more particularly to hydraulic valve lifters for an internal combustion engine.

An object of the present invention is to provide a valve lifter or tappet which is light in weight for reduced inertia and which can rest on one of two different profiled cams with little mechanical interference with the other cam.

SUMMARY OF THE INVENTION

According to the present invention, a valve lifter for an internal combustion engine having a cylinder head and a camshaft, the camshaft having a set of different adjacent cams including a first cam and a second cam comprises:

a lifter body formed with a bore, said lifter body having a first surface adapted to rest on the first cam for reciprocal motion and a window opening to said bore; and means, disposed in said bore for unitary motion with said lifter body during the reciprocal motion of said lifter body, said means being shiftable to a first state in which said means is operable to define, within said bore, a chamber adapted to allow entry of the second cam through said window, said means being shiftable also to a second state in which said means is operable to define, opposite to said window, a second surface adapted to rest on the second cam.

DETAILED DESCRIPTION OF THE INVENTION

Referring to FIGS. 1 to 7, a first embodiment according to the present invention is described.

Figure 1:
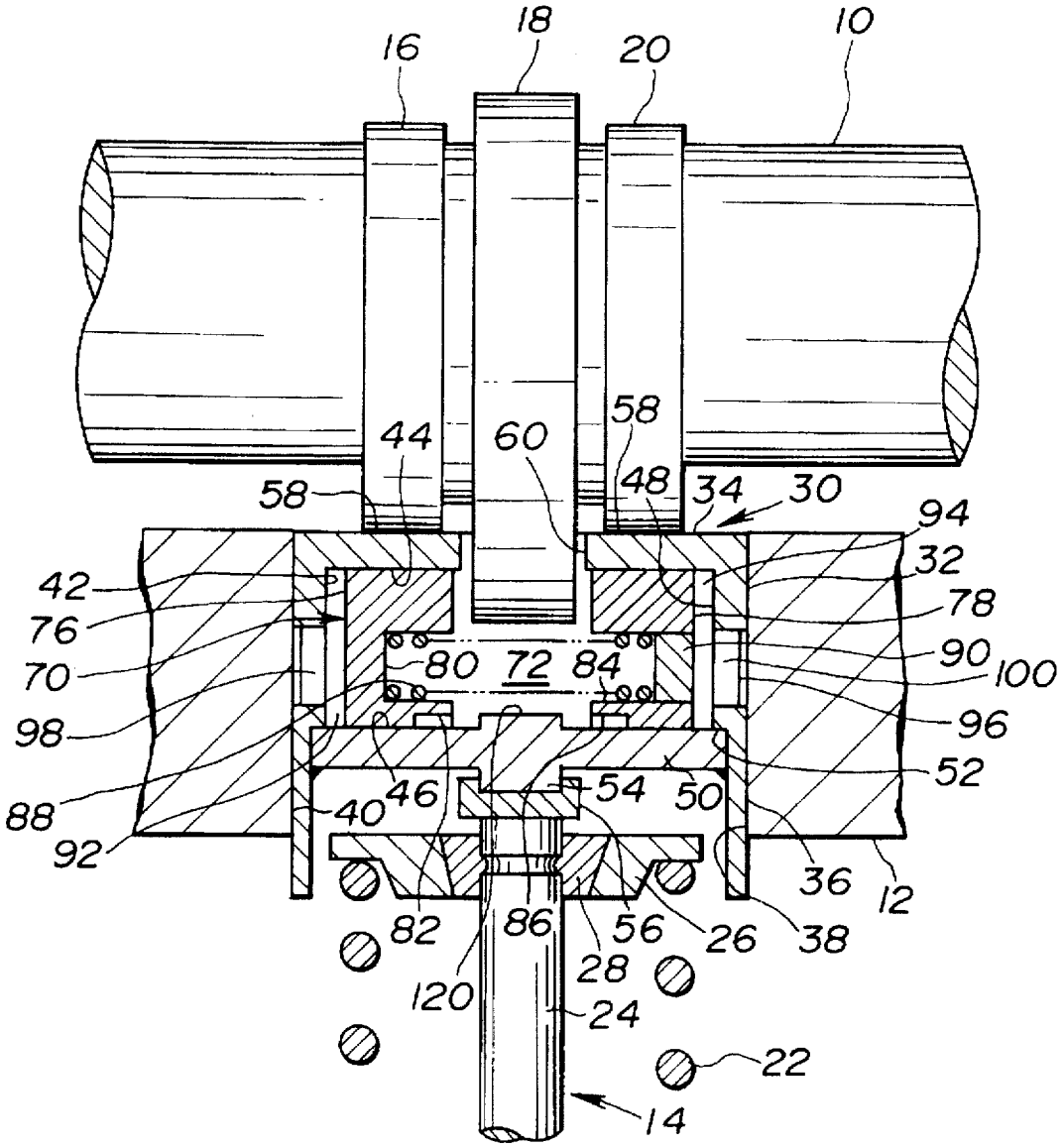
FIG. 1 is a fragmentary view of a cylinder head of an overhead camshaft engine partly sectioned through the line A—A of FIG. 2, showing a valve lifter lifted by a pair of low lift cams with a hydraulic mechanism in a stored position.
Figure 2:
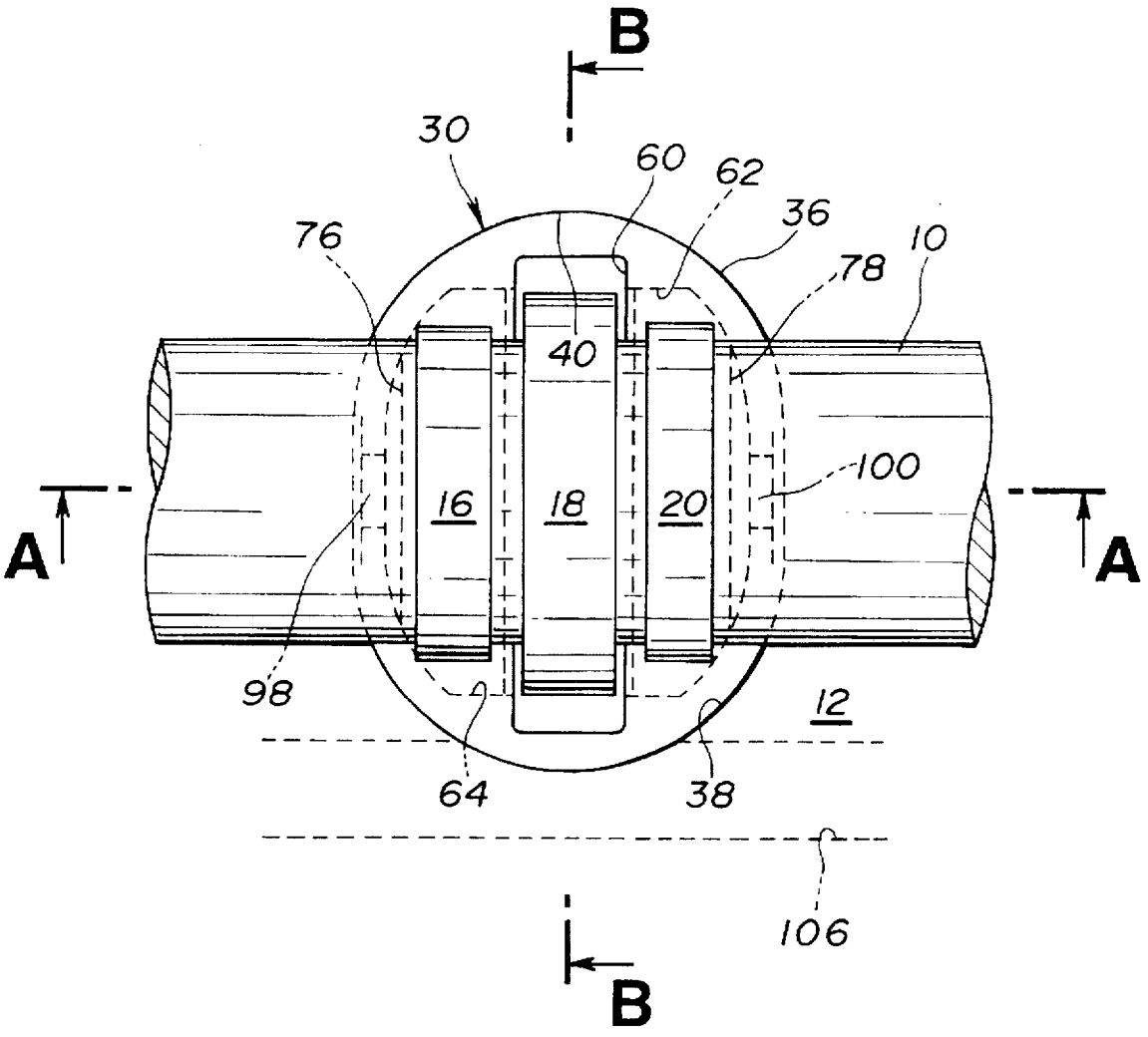
FIG. 2 is a fragmentary plan view of the cylinder head shown in FIG. 1.
Figure 3:
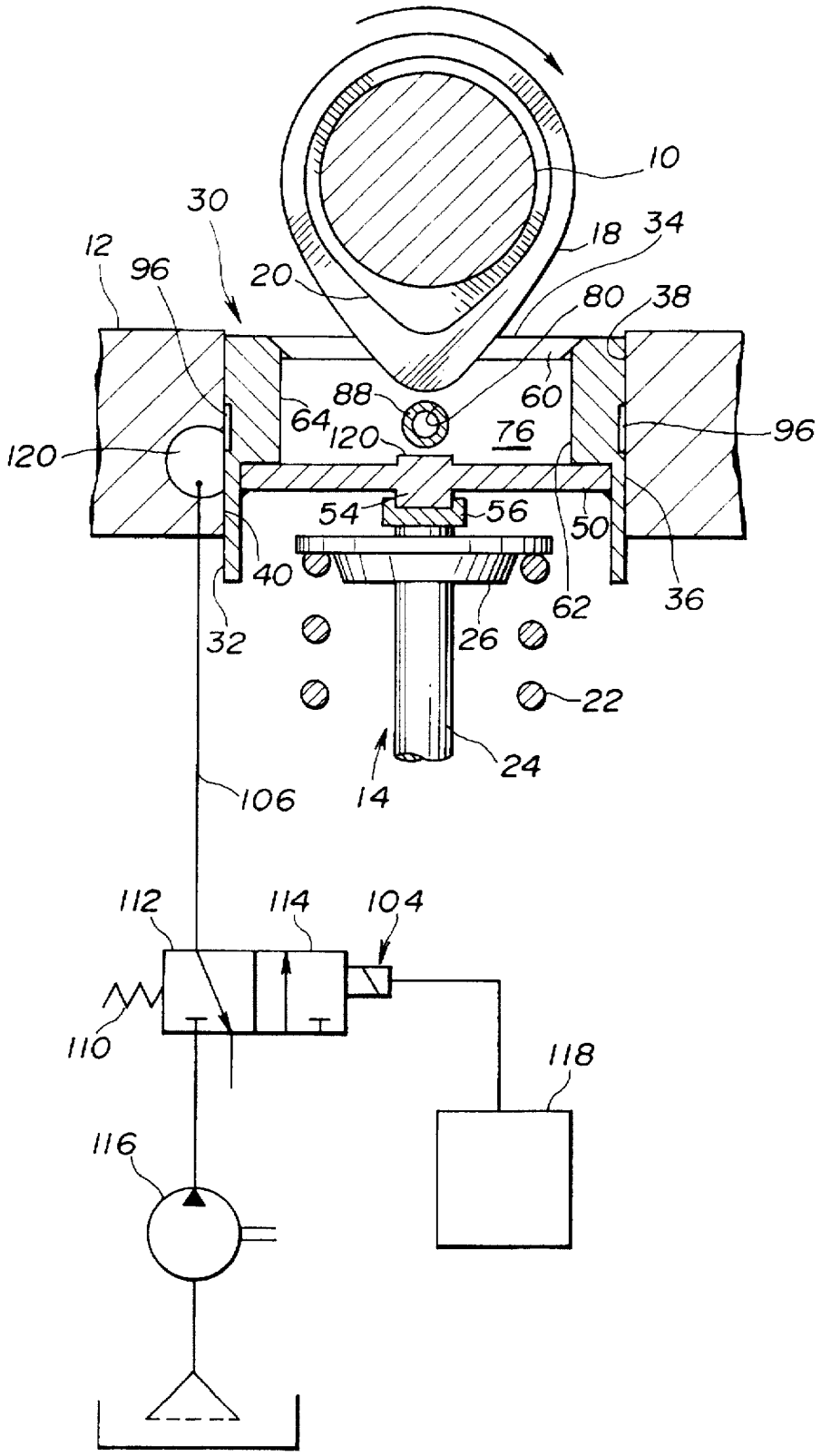
FIG. 3 is a section through the line B—B of FIG. 2.

Referring to FIG. 1 to 3 there is shown a camshaft 10 supported by cam brackets, not shown, above a cylinder head 12 of an overhead camshaft multi-cylinder internal combustion engine. The camshaft 10 is drivingly associated with a plurality of cylinder valves and driven by the engine crankshaft. In this embodiment, the camshaft 10 is arranged in driving association with the engine intake valves, only one being shown at 14.

Figure 5:
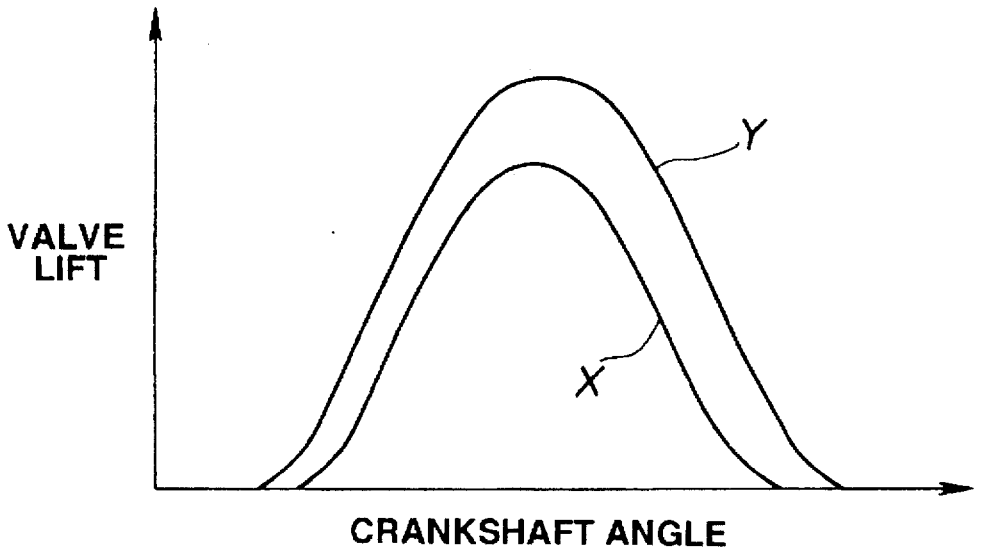
FIG. 5 show two valve lift vs. crankshaft angle plots.

The camshaft 10 has a set of different profiled adjacent cams, per each cylinder valve 14, including a first or low speed low lift cam 16 and a second or high speed high lift cam 18. Preferably, each set includes an identical low speed low lift cam 20 which is spaced from the low speed cam 16 no form a pair. The high speed cam 18 is situated between the pair of low speed cams 16 and 20. The low speed cams 16 and 20 are of the identical profile which shows a valve lift vs. crankshaft angle plot X as shown in FIG. 5. The high speed cam 18 has a profile which snows a valve lift vs. crankshaft angle plot Y as shown in FIG. 5. The low speed cams 16 and 20 of each pair have a common width which is narrower than the width of the associated high speed cam 18.

The valve 14 is resiliently biased toward a closed or seated position thereof by a valve spring 22 arranged around a seem 24 and acting on a spring retainer 26 fixed to the stem 24 by a cotter 28. The valve 14 is raised from the seated position thereof against the valve spring 22 by the low speed cams 16 and 20 or the high speed cam 18 through a valve lifter or tappet 30.

The valve lifter 30 comprises a lifter body 32 having an upper end wall 34 and a generally cylindrical outer peripheral wall 36 having one or upper end connected to and extending from the upper end wall 34. The lifter body 32 has a common transverse cross-sectional profile that is defined by two semicircles spaced and interconnected by two parallel line segments (see FIG. 2). The lifter body 32 is guided by the cylinder head 12. Specifically, the cylinder head 12 is formed with a through bore 38 serving as a valve lifter guide and includes a generally cylindrical wall 40 defining the through bore 38. The lifter body 32 is slidably disposed in the through bore 38 of the cylinder head 12 with its generally cylindrical outer peripheral wall 36 in slidable engagement with the bore defining wall 40.

As shown in FIGS. 1 and 3, the lifter body 32 is formed with a bore 42 and includes two spaced inner upper and lower end walls 44 and 46 and inner side wall 48 (see FIG. 2 also) interconnecting the inner end walls 44 and 46 to define the bore 42. The inner lower end wall 46 is formed on a cap 50 resting on an inner shoulder 52 of the lifter body 32 and fixedly secured thereto. The cap 50 has a downwardly projecting central boss 54 received in a shim 56 on an upper end of the stem 24.

The lifter body 32 has a first surface 58 adapted to rest on the pair of low speed cams 16 and 20 for reciprocal motion and a window 60 opening to the bore 42. The first surface 58 is formed on the upper end wall 34 and the window 60 is open at the upper end wall 34. As best seen in FIG. 2, the window 60 is rectangular and dimensioned to allow entry of the high speed cam 18 into the bore 42.

As indicated by the broken line in FIG. 2, the inner side wall 48 defining the bore 42 includes two opposed flat wall sections 62 and 64 which are spaced transversely with respect to an axis of rotation of the camshaft 10.

Figure 6:
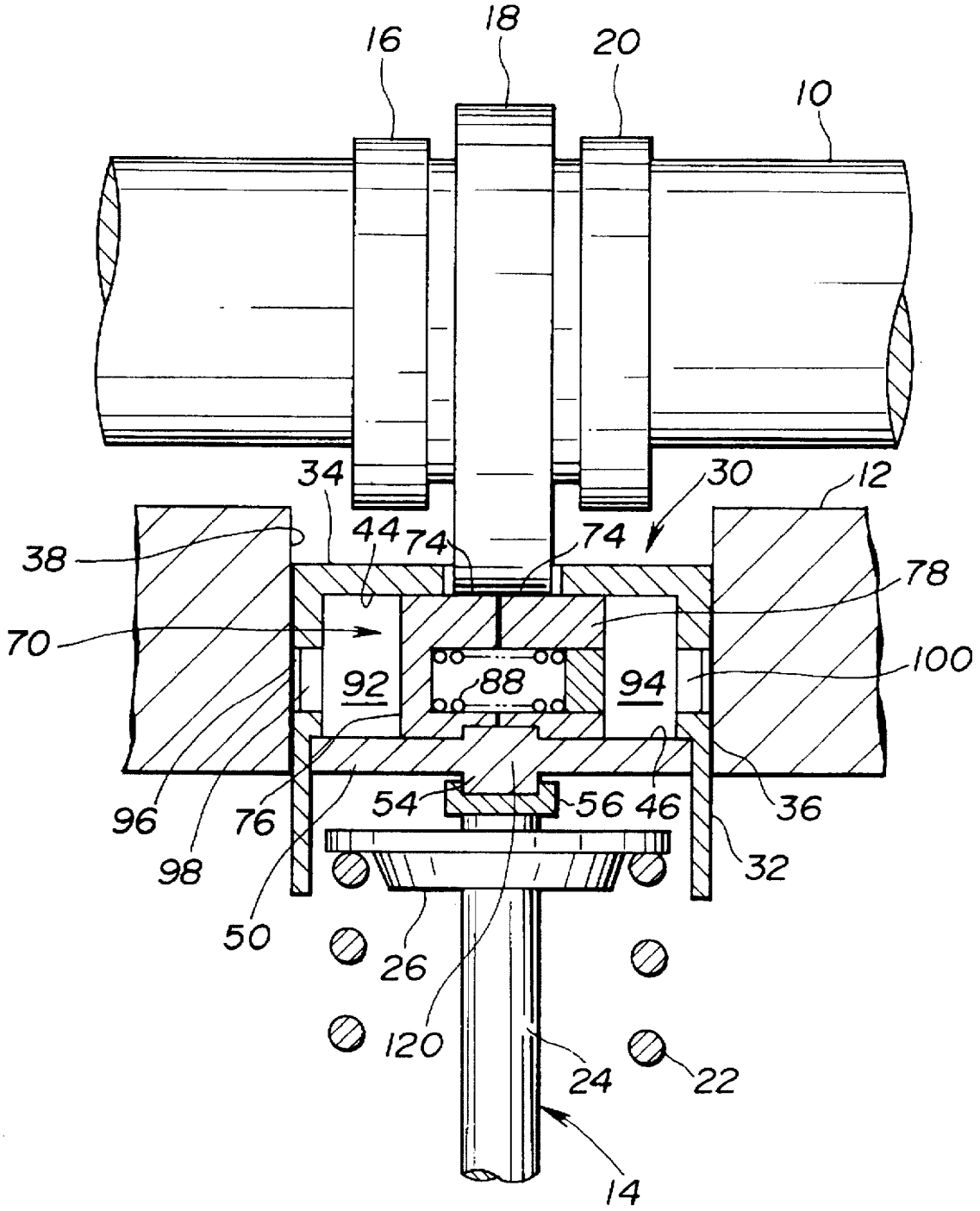
FIG. 6 is a similar view to FIG. 1, showing the valve lifter lifted by a high lift cam with the hydraulic mechanism in an operative position.
Figure 7:
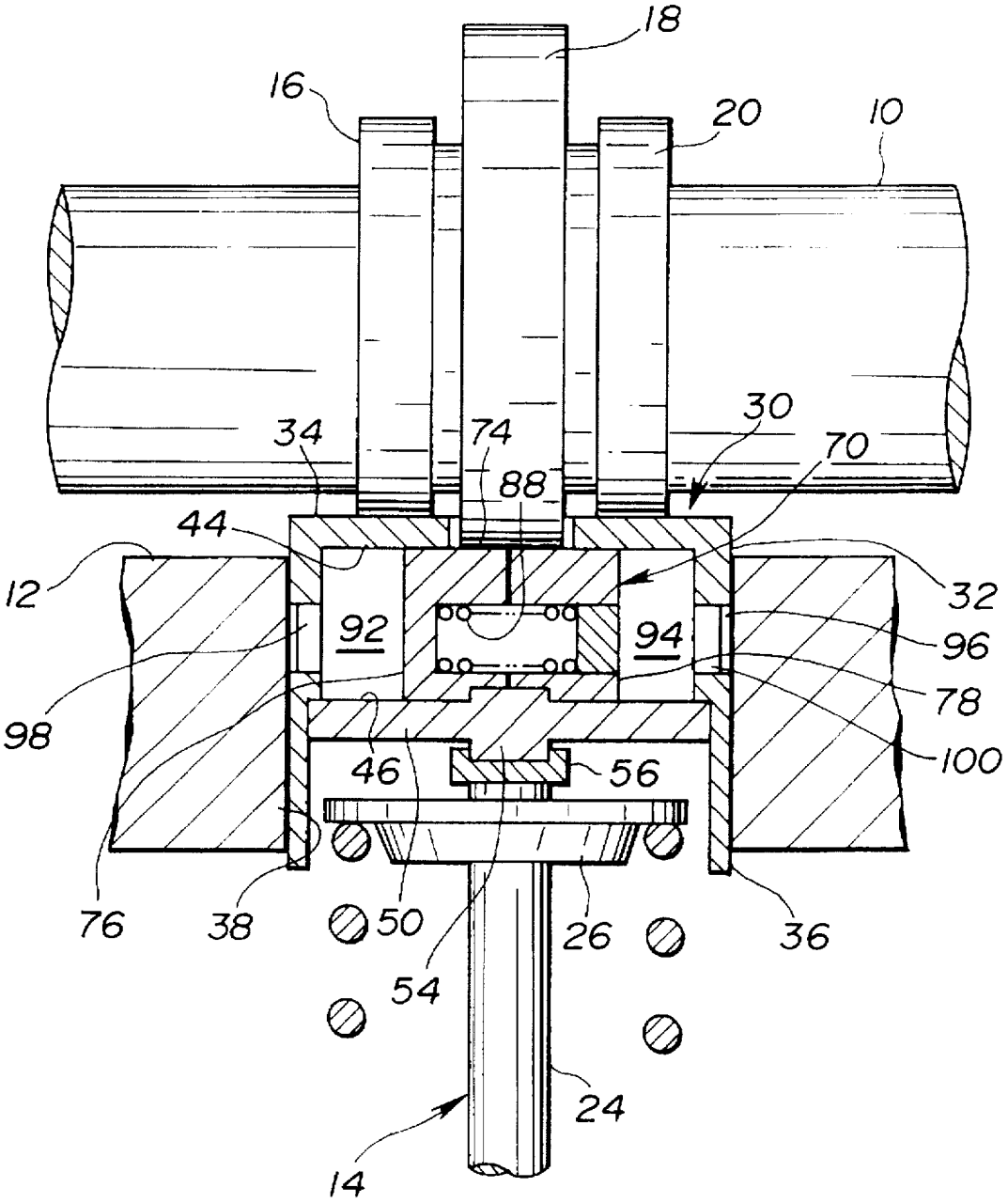
FIG. 7 is a similar view to FIG. 1, showing the valve lifter unlifted with the hydraulic mechanism in the operative position.

A hydraulic mechanism 70 is disposed in the bore 42 for unitary motion with the lifter body 32 during the reciprocal motion of the lifter body 32. The hydraulic mechanism 70 has two states, namely a first state and a second state, and is shiftable to one of the two states. In the first state as shown in FIG. 1, the hydraulic mechanism 70 defines, within the bore 42 and opposite to the window 60, a chamber or space 72 which allows entry of the high speed cam 18 through the window 60. In the second state as shown in FIGS. 6 and 7, the hydraulic mechanism defines, opposite to the window 60, a second surface 74 adapted to rest on the high speed cam 18.

Figure 4:
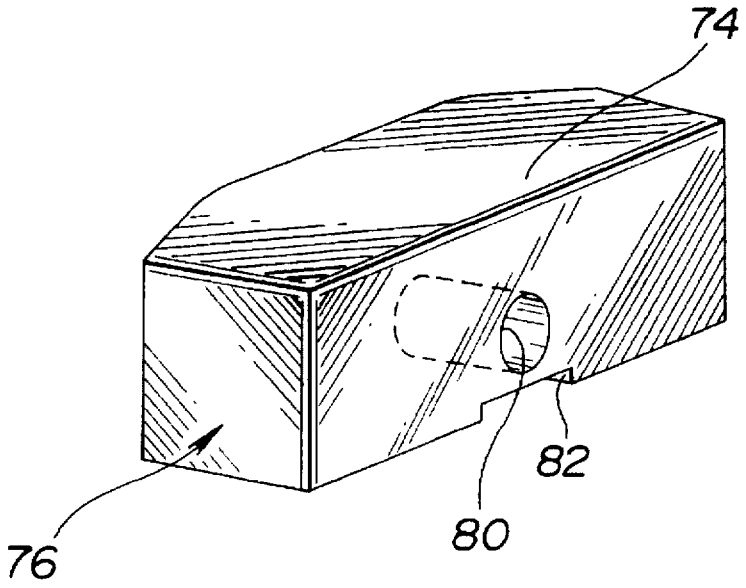
FIG. 4 is a perspective view of a slide used in FIG. 1.

The hydraulic mechanism 70 includes at least one force transmitting member having the second surface 74 thereon and Preferably a pair of slides 76 and 78 slidably disposed in the bore 42. As best seen in FIG. 4, the slide 76 has a central recess 80 and a cutout 82 below the central recess 80. Similarly, the slide 78 has a central hole 84 and a cutout 86 below the central hole 84. A return coil spring 88 is inserted through the central hole 84 into the central recess 80 and a plug 90 closes the central hole 84 by press fit. The return spring 88, disposed between the slides 76 and 78, acts on the slides 76 and 78 to resiliently hold the slides 76 and 78 at a stored position thereof as illustrated in FIG. 1. The slide 76 defines within the bore 42 a pressure chamber 92, and the slide 78 defines within the bore 42 a pressure chamber 94. As best seen in FIGS. 1 and 3, the lifter body 32 is formed with a circumferential groove 96 in the generally cylindrical outer peripheral wall 36. The circumferential groove 96 has a port 98 opening to the pressure chamber 92 and another port 100 opening to the pressure chamber 94 for supply of hydraulic fluid, for example, oil, to and discharge thereof from the pressure chambers 92 and 94, respectively. The circumferential groove 96 is arranged within an area such that, during the reciprocal motion of the lifter body 32, this area is covered by the through bore defining wall 40 of the cylinder head 12. The cylinder head 12 is formed with a port 102 within the wall 40 (see FIG. 3). The arrangement is such that the port 102 overlaps the circumferential groove 96 during the reciprocal motion of the lifter body 32.

As shown in FIG. 3, the port 102 is connected to a solenoid operated control valve 104 through a hydraulic fluid line 106. The control valve 104 includes a solenoid 108 and a return spring 110. The control valve 104 has two positions, namely, a discharge position 112 and a supply position 114. When the solenoid 108 is not energized, the return spring 110 sets the discharge position 112 wherein the hydraulic fluid line 106 is disconnected from a pump 116 and connected to a drainage, causing discharge of hydraulic fluid from the pressure chambers 92 and 94. Upon energization of the solenoid 108, the control valve 104 shifts to the supply position 114 against the bias of the return spring 110. In the supply position 114, the hydraulic fluid line 106 is disconnected from the drainage and connected to the pump 116, causing supply of pressurized hydraulic fluid to the pressure chambers 92 and 94.

Energization of the solenoid 108 is controlled by a controller 118. The controller 118 receives information of engine speed, intake air quantity or flow rate and engine coolant temperature from outputs of a crankshaft angle sensor, an air flow meter and a coolant temperature sensor.

When the pressure chambers 92 and 94 are depressurized, the slides 76 and 78 are held at the illustrated stored position in FIG. 1. Pressurizing the pressure chambers 92 and 94 biases the slides 76 and 78 toward each other against the return spring 88 for movement away from the generally cylindrical outer peripheral wall 36 inward of the lifter body 32 toward an operative position as illustrated in 6 and 7. In the operative position, an upwardly projecting stop 120 on the cap 50 is received in the cutouts 82 and 86 of the slides 76 and 78, and the slides 76 and 78 define the second surface 74 opposite to or below the window 60. As is readily seen from FIG. 4, each of the slides 76 and 78 has a flat top wall and thus the second surface 74 defined on the flat top walls is inevitably flat.

As is readily seen from FIGS. 6 and 7, the slides 76 and 76 are disposed in force transmitting manner between the high speed cam 18 and the lifter body 32.

The controller 118 issues an OFF signal at low and middle engine speeds, causing denergization of the solenoid 188. Since the solenoid 108 is not energized, the control valve 104 assumes the discharge position 112, causing discharge of hydraulic fluid from the pressure chambers 92 and 94. Thus, the return spring 88 resiliently holds the slides 76 and 78 at the stored position as illustrated in FIG. 1. In this stored position, the slides 76 and 78 define therebetween the chamber 72 which allows entry of the high speed cam 18 through the window 60 so that the high speed cam 18 will not strike or engage any part of the valve lifter.

Since, in this stored position, the lifter body 32 rests on the low speed cams 16 and 20, the valve lifter 30 reciprocates in response to rotation of the low speed cams 16 and 20.

Figure 8:
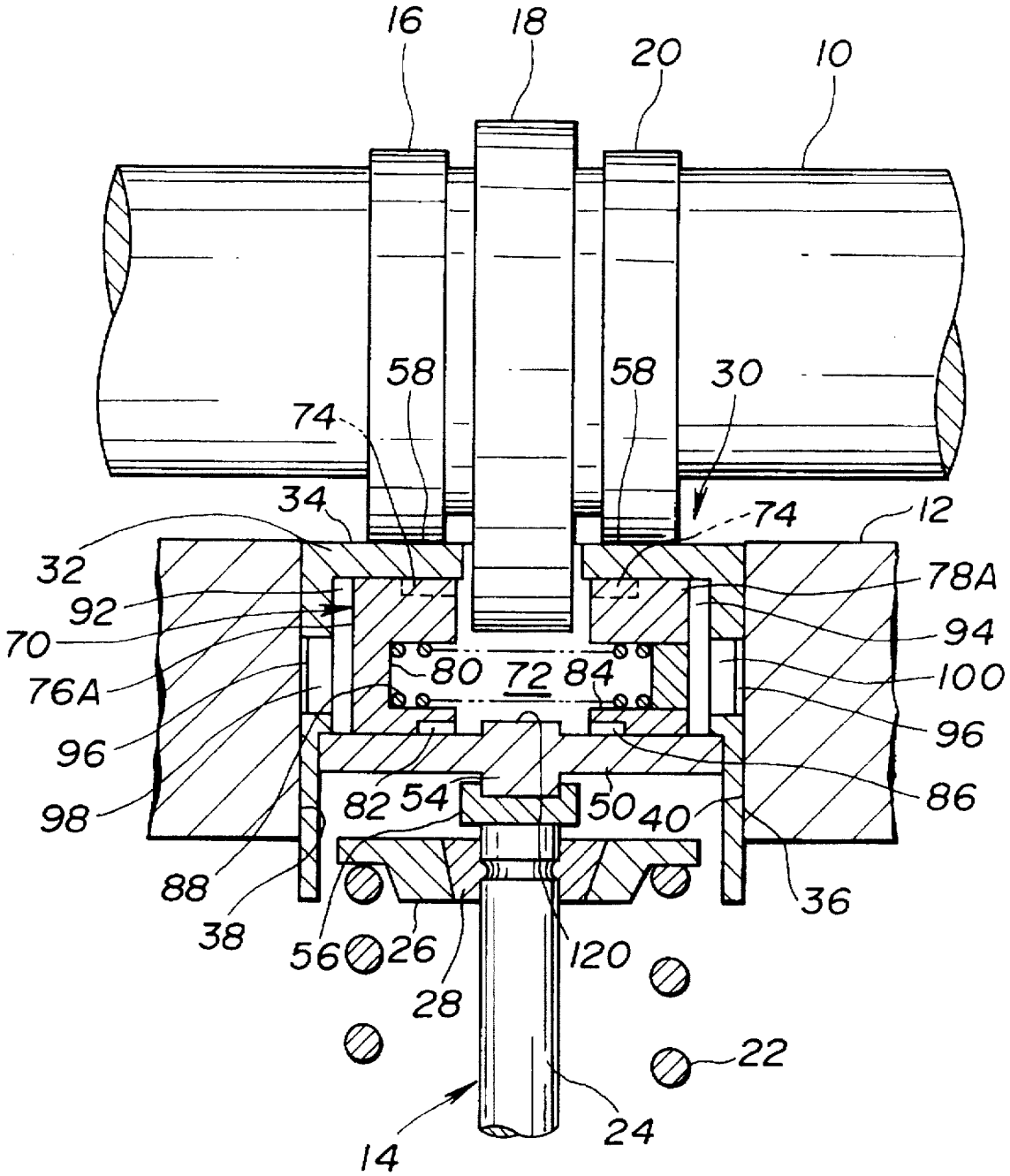
FIG. 8 is a fragmentary view of a cylinder head of an overhead camshaft engine partly sectioned through the line C—C of FIG. 9, showing a modified valve lifter lifted by a pair of low lift cams with a hydraulic mechanism in a stored position.
Figure 9:
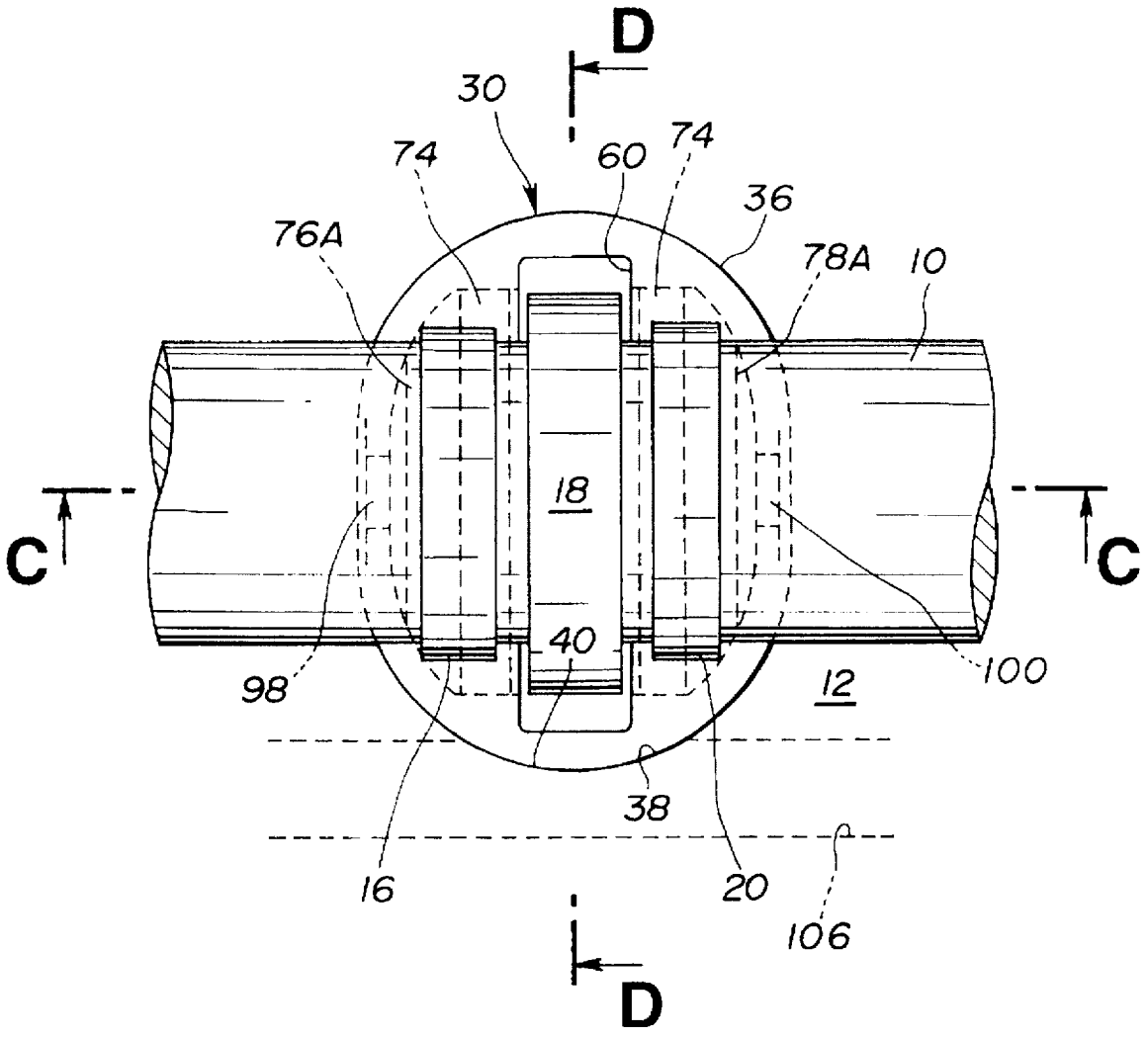
FIG. 9 is a fragmentary plan view of the cylinder head shown in FIG. 8.
Figure 10:
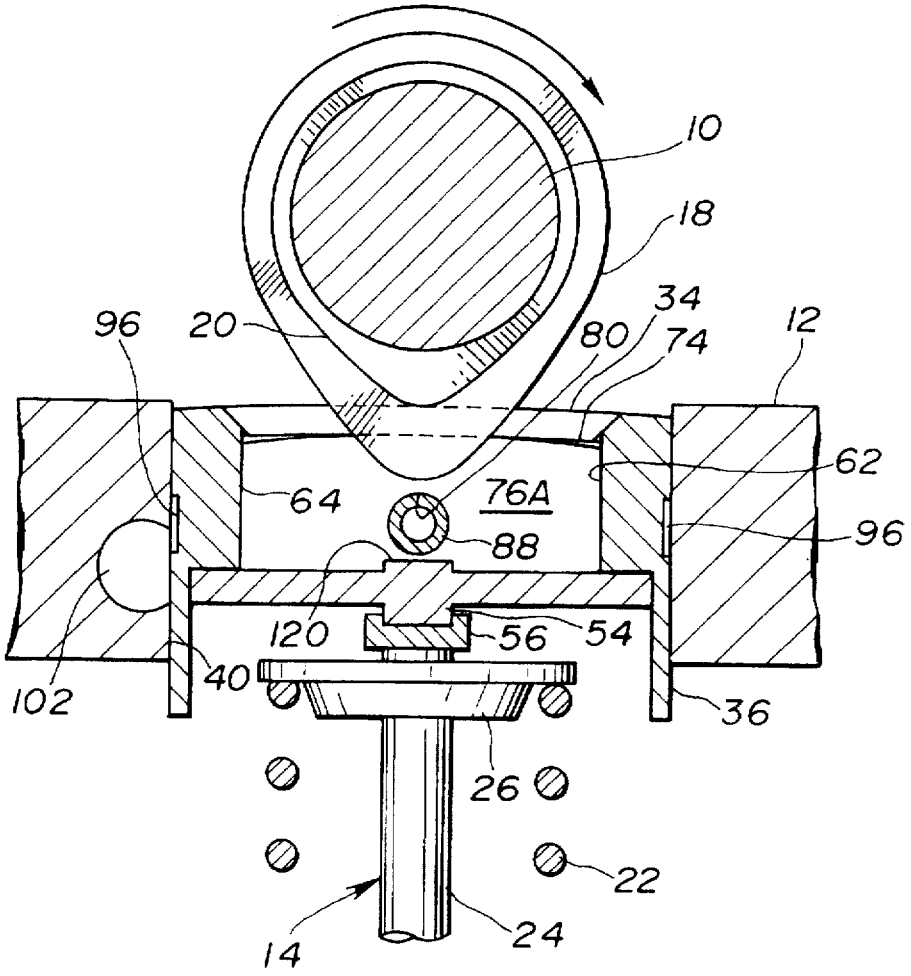
FIG. 10 is a section through the line D—D of FIG. 9.

When the engine enters high speed operation, the controller 118 issues an ON signal, causing energization of the solenoid 108. Then, the control valve 104 shifts to the supply position 114, causing supply of hydraulic fluid to the pressure chambers 92 and 94. Pressurization of the pressure chambers 92 and 94 moves the slides 76 and 78 toward each other against the action of the return spring 88 to the operative position as illustrated in FIGS. 7 and 8. In this operative position, the slides 76 and 78 rest on the high speed cam 18 through the window 60. Specifically, the high speed cam 18 strikes or engage the second flat surface 74 defined by the slides 76 and 78 in the operative position.

As is seen from FIGS. 6 and 7, when the slides 76 and 78 are in the operative position, the low speed cams 16 and 20 are out of contact with the valve lifter 30 when the valve lifter 30 is lifted by the high speed cam 18.

As is seen from FIG. 1, when the slides 76 and 78 are in the stored position, the high speed cam 18 is out of contact with the valve lifter 30 not only when the valve lifter 38 is lifted, but also when the valve lifter 30 is not unlifted.

From the preceding description of the first embodiment, it is well appreciated that friction between the cams 16, 18 and 20 and the valve lifter 30 has been reduced.

Figure 11:
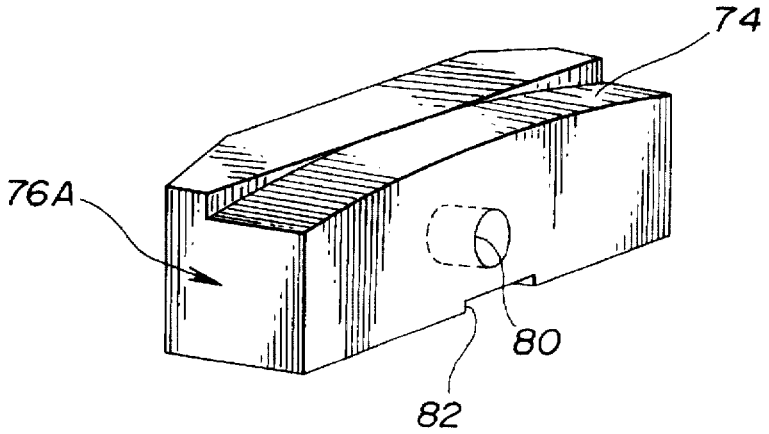
FIG. 11 is a perspective view of a modified slide used in FIG. 8.

Referring to FIGS. 8 to 11, the second embodiment is described. This second embodiment is substantially the same as the previously described first embodiment except the provision of a pair of modified slides instead of the slides 76 and 78. The pair of modified slides are denoted by the reference numerals 76A and 78A, respectively. As best seen in FIG. 11, the slide 76A has a front portion of its flat top wall machined to form a cylindrically curved surface. Similarly the slide 78A has a front portion of its flat top wall machined to form a cylindrically curved surface. When the slides 76A and 78A are in an operative position, the cylindrically curved surfaces cooperate with each other to define a second surface 74 which is curved cylindrically in a direction of movement of a second cam 18. Except this feature, the slides 76A and 78A are substantially the same as the previously described slides 76 and 78.

With this cylindrically curved second surface 74, the friction with the high speed cam 18 has been reduced.

Figure 12:
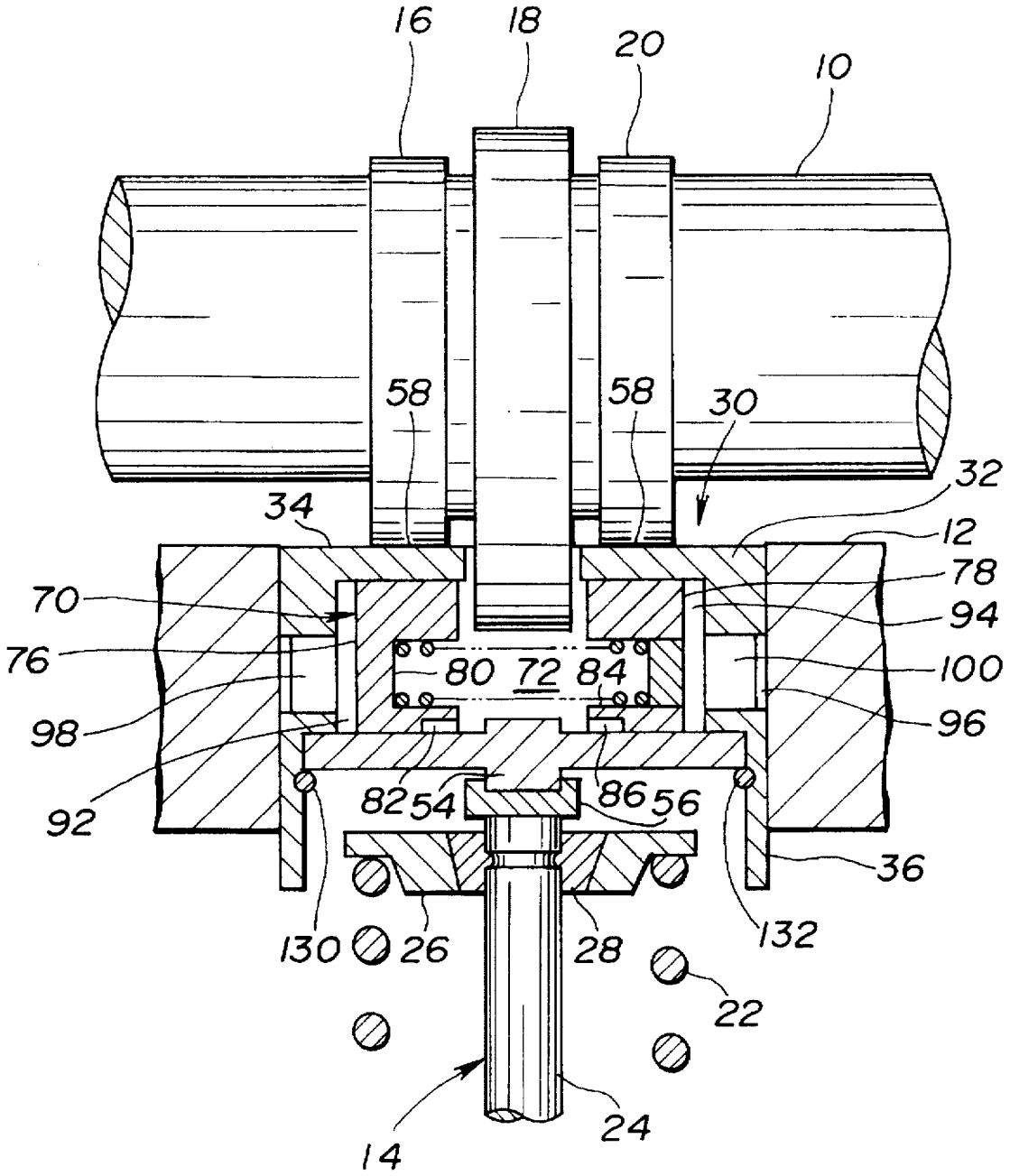
FIG. 12 is a fragmentary view of a cylinder head of an overhead camshaft engine partly sectioned through the line E—E of FIG. 13, showing a further modified valve lifter lifted by a pair of low lift cams with a hydraulic mechanism in a stored position.
Figure 13:
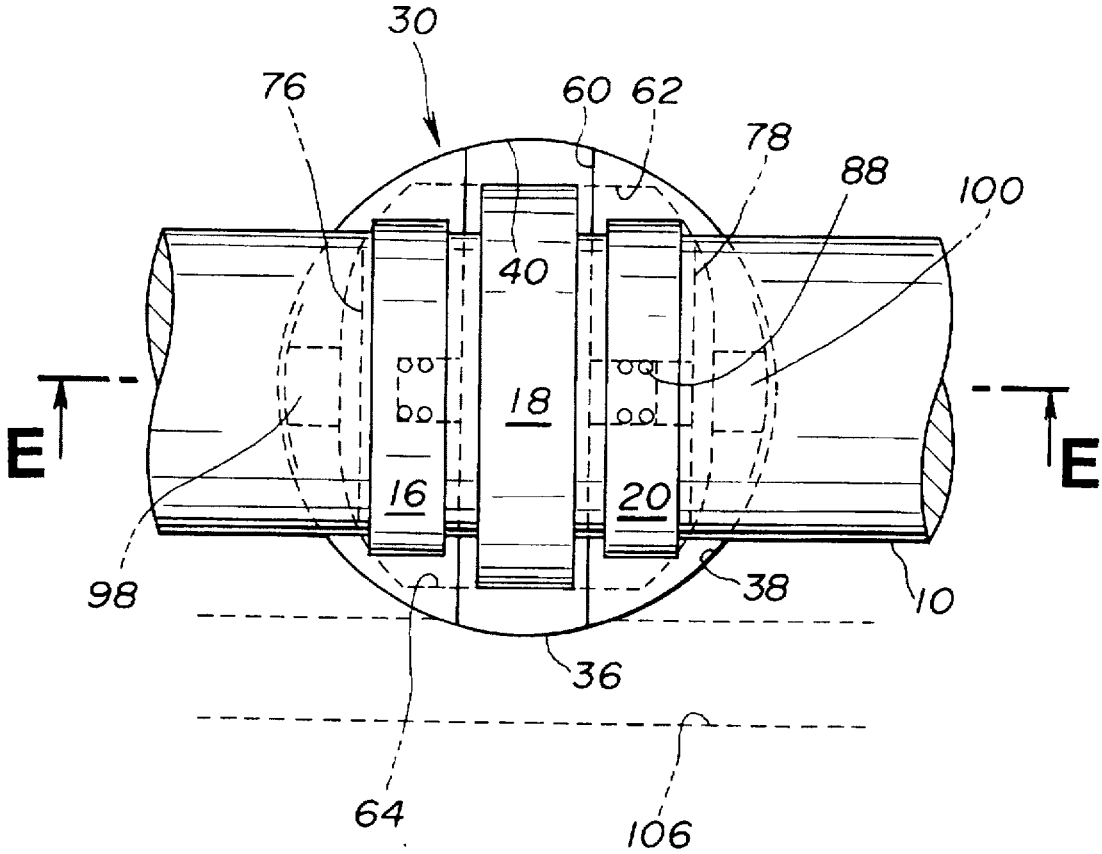
FIG. 13 is a fragmentary plan view of the cylinder head shown in FIG. 12.

Referring to FIGS. 12 and 13, the third embodiment is described. This third embodiment is substantially the same as the first embodiment except the transverse cross sectional profile of a valve lifter and the manner of securing a cap to a lifter body. In the third embodiment, the transverse cross sectional profile of a lifter body 32 and thus that of a through bore 38 are spherical and a cap 50 is fixedly held on the lifter body 32 by means of a stop ring 130 received in a groove 132 (see FIG. 12).

Figure 14:
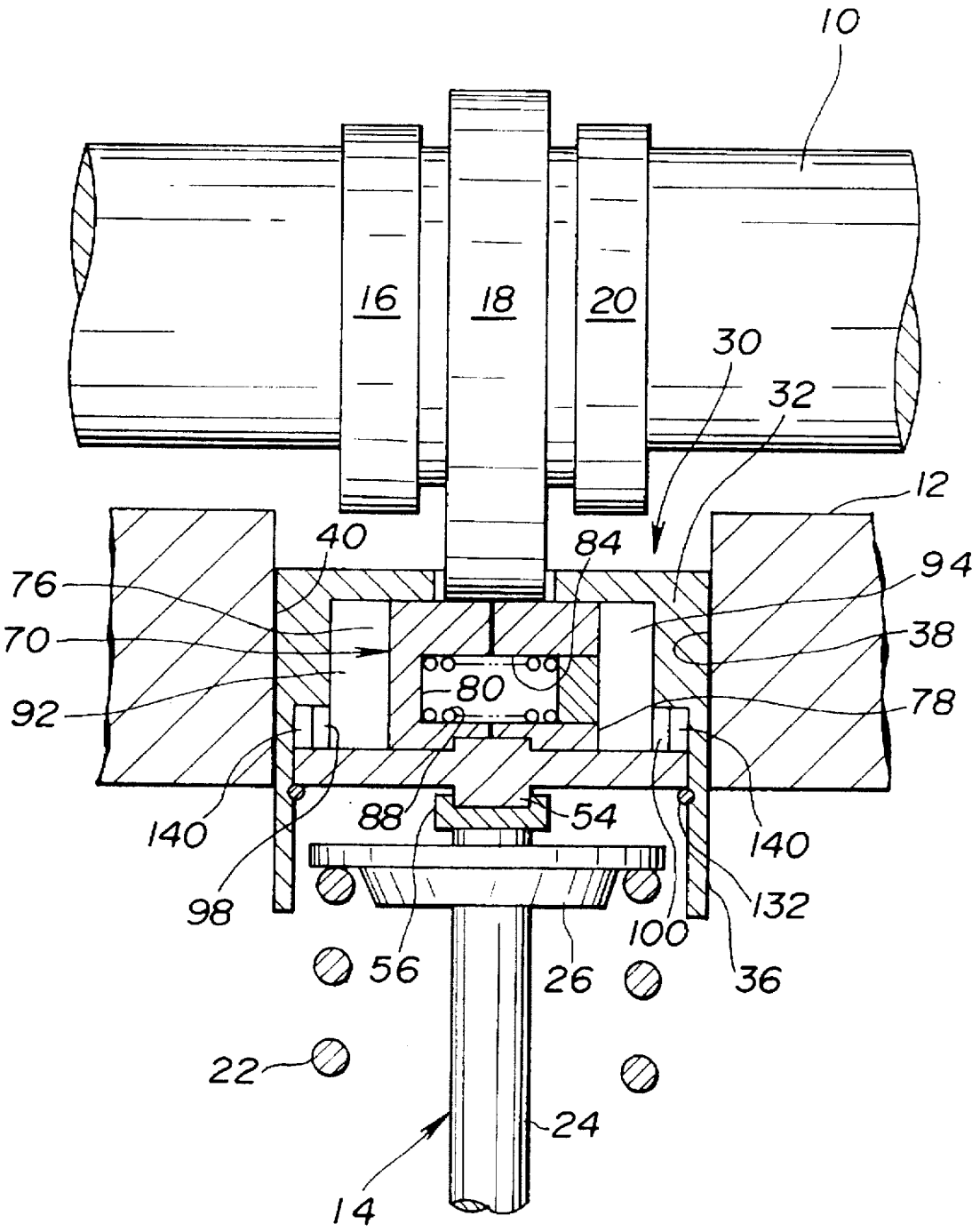
FIG. 14 is a similar view to FIG. 6, showing another modified valve lifter lifted by a high lift cam with a hydraulic mechanism in an operative position.
Figure 15:
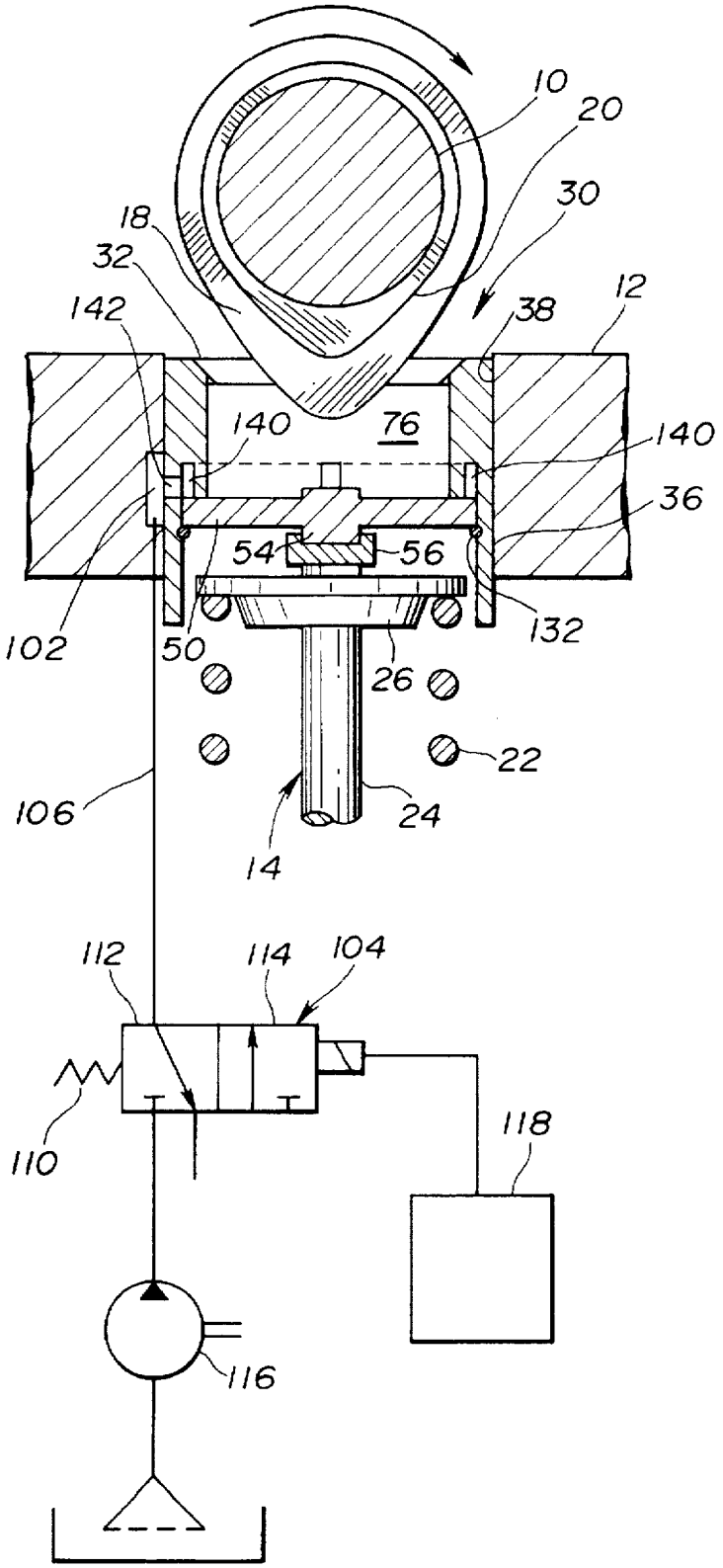
FIG. 15 is a similar view to FIG. 3, showing the valve lifter of FIG. 14 lifted by a pair of low lift cams.

Referring to FIGS. 14 and 15, the fourth embodiment is described. This fourth embodiment is substantially the same as the third embodiment except the structure of supplying hydraulic fluid to and discharging thereof from pressure chambers 92 and 94. In this fourth embodiment, the circumferential groove 96 used in the previously described embodiments is replaced by an internal passage 140 and a single peripheral port 142 (see FIG. 15) of a lifter body 32. The internal passage 140 has a port 98 opening to a pressure chamber 92 and a port 100 opening to a pressure chamber 94. As readily seen from FIG. 14, the internal passage 140 and the ports 98 and 100 are defined by a cap 50 and the adjacent shoulder portion of the lifter body 32. The single peripheral port 142 communicates with the internal passage 140 and arranged within an area such that, during reciprocal motion of the lifter body 32, this area is covered by through bore defining wall 40 of a cylinder head 12. The cylinder head 12 is formed with a port 102 in the wall 40. The port 102 overlaps the peripheral port 142 of the lifter body 32 during reciprocal motion of the lifter body 32.

Figure 16:
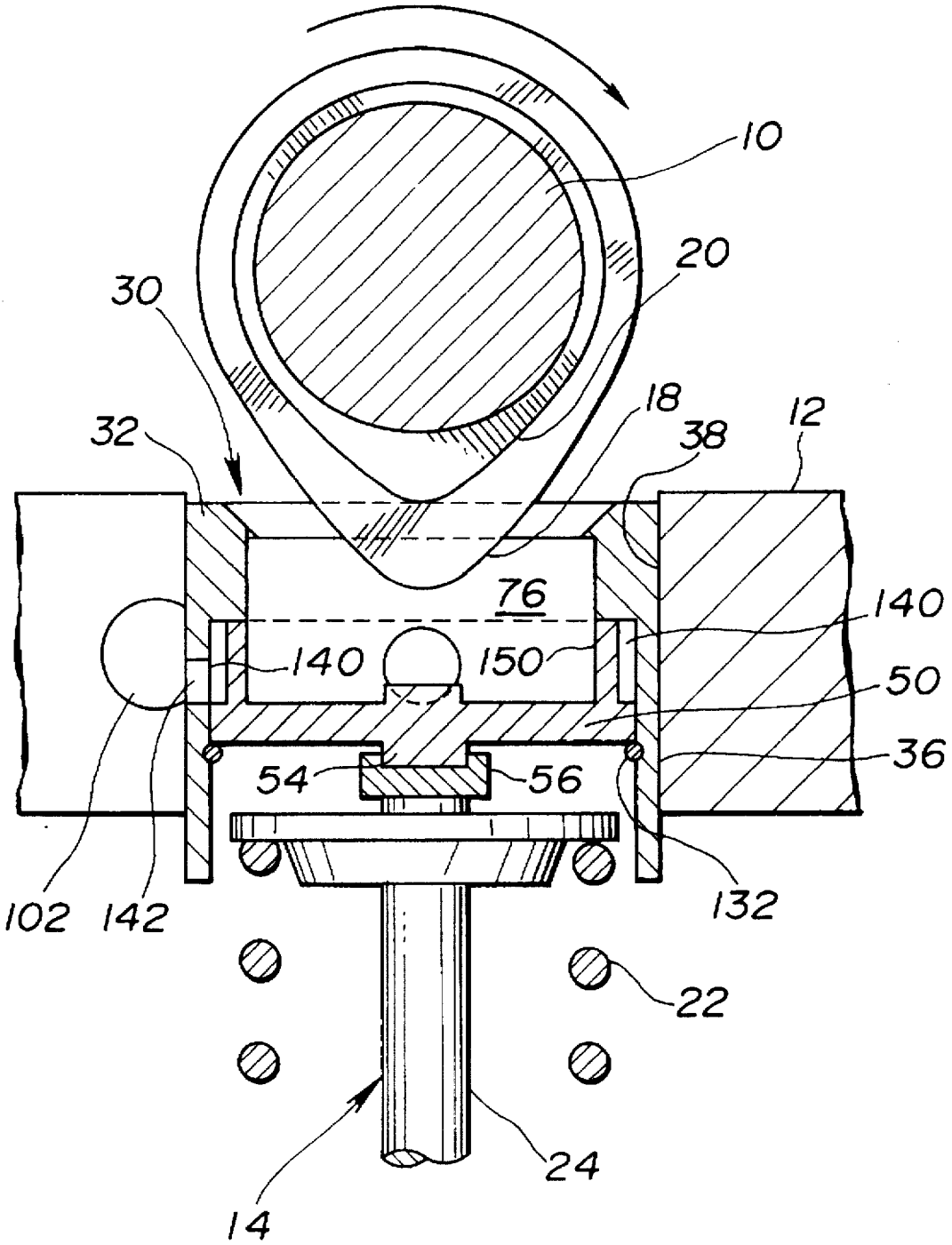
FIG. 16 is a similar view to FIG. 15, showing still another modified valve lifter lifted by a pair of low lift cams.

Referring to FIG. 16, the fifth embodiment is described. This fifth embodiment is substantially the same as the fourth embodiment except the structure of defining an internal passage 140. In this embodiment, a cap 50 has an integral cylindrical standing wall 150 which defines the internal passage 140 in cooperation with a lifter body 32.

What is claim is:

1. A valve lifter for an internal combustion engine having a cylinder head and a camshaft, the camshaft having a set of different adjacent cams including a first cam and a second cam, comprising:

a lifter body formed with a bore, said lifter body having a first surface adapted to rest on the first cam for reciprocal motion and a window opening to said bore; and means disposed in said bore for unitary motion with said lifter body during the reciprocal motion of said lifter body, said means is operable in a first state to define, within said bore, a chamber adapted to allow entry of the second cam through said window and into the chamber so as to have the second cam not in contact with said lifter body and means for unitary motion;

said means being shiftable also to a second state in which said means is operable to define, adjacent to said window, a second surface adapted to rest on the second cam.

2. A valve lifter as claimed in claim 1, wherein said means include at least one force transmitting member slidably disposed in said bore, said force transmitting member being movable within said bore from a stored position to an operative position wherein said force transmitting member is disposed in force transmitting manner between the second cam and said lifter body.

3. A valve lifter as claimed in claim 2, wherein said window is disposed adjacent said first surface.

4. A valve lifter as claimed in claim 3, wherein said lifter body is slidably disposed in a through bore of the cylinder head.

5. A valve lifter as claimed in claim 4, wherein said lifter body has an end wall and an outer peripheral wall having one end connected to and extending from said end wall.

6. A valve lifter as claimed in claim 5, wherein said end wall is formed with said first surface, and said window is open at said end wall.

7. A valve lifter as claimed in claim 6, wherein said force transmitting member is arranged to move away from said outer peripheral wall inward of said lifter body.

8. A valve lifter as claimed in claim 6, wherein said means include a return spring acting on said force transmitting member to resiliently hold said force transmitting member to said stored position thereof, and pressure chamber means for biasing said force transmitting member against said return spring for movement toward said operative position thereof.

9. A valve lifter as claimed in claim 8, wherein said lifter body is formed with a groove in said outer peripheral wall, said groove having a port opening to said pressure chamber means for supply of hydraulic fluid to and discharge of hydraulic fluid from said pressure chamber means.

10. A valve lifter as claimed in claim 9, wherein said groove is arranged within an area such that, during the reciprocal motion of said lifter body, said area is covered by the through bore defining wall of the cylinder head, and wherein the cylinder head is formed with a port, within the through bore defining wall of the cylinder head, which overlaps said groove during the reciprocal motion of said lifter body.

11. A valve lifter as claimed in claim B, wherein said lifter body is formed with a passage having a port opening to said pressure chamber means for supply of hydraulic fluid to and discharge of hydraulic fluid from said pressure chamber means.

12. A valve lifter as claimed in claim 11, wherein said lifter body is formed with a peripheral port communicating with said passage, said peripheral port being arranged within an area such that, during the reciprocal motion of said lifter body, said area is covered by the through bore defining wall of the cylinder head, and wherein the cylinder head is formed with a port, within the through bore defining wall of the cylinder head, which overlaps said peripheral port of said lifter body during the reciprocal motion of said lifter body.

13. A valve lifter as claimed in claim 8, wherein said force transmitting member has said second surface thereon, which second surface is curved cylindrically in a direction of movement of the second cam.

14. A valve lifter for an internal combustion engine having a cylinder head and a camshaft, the camshaft having a set of different adjacent cams including a first cam and a second comprising;

a lifter body form with a bore, said lifter body having a first surface adapted to rest on the first cam for reciprocal motion and window opening to said bore; and means disposed in said bore for unitary motion with said lifter during the reciprocal motion of said lifter body, said means is operable in a first state to define, within said bore, a chamber adapted to allow entry of the second cam through said window;

said means being shiftable also to a second state in which said means is operable to define adjacent to said window, a second surface adapted to rest on the second cam, wherein said means includes a pair of slides dispose in said bore, said pair of slides being movable toward each other from a store position to an operative position wherein said pair of slides are disposed in force transmitting manner between the second cam and said lifter body.

15. A valve lifter as claimed in claim 14, wherein said window is disposed adjacent said first surface.

16. A valve lifter as claimed in claim 15, wherein said lifter body is slidably disposed in a through bore of the cylinder head.

17. A valve lifter as claimed in claim 16, wherein said lifter body has an end wall and an outer peripheral wall connected to and extending from said end wall.

18. A valve lifter as claimed in claim 17, wherein said end wall is formed with said first surface, and said window is open at said end wall.

19. A valve lifter as claimed in claim 18, wherein said pair of slides are arranged to move away from said outer peripheral wall inward of said lifter body.

20. A valve lifter as claimed in claim 19, wherein said means include a return spring disposed between and acting on said pair of slides to resiliently hold said pair of slides at said stored position thereof, and a pair of pressure chamber means for biasing said pair of slides toward each other against said return spiring for movement toward said operative position thereof.

21. A valve lifter as claimed in claim 20, wherein said lifter body is formed with a circumferential groove in said outer peripheral wall, said circumferential groove having two ports opening to said pair of pressure chamber means, respectively, for supply of hydraulic fluid to add discharge of hydraulic fluid from said pair of pressure chamber means.

22. A valve lifter as claimed in claim 21, wherein said circumferential groove is arranged within an area such that, during the reciprocal motion of said lifter body, said area is covered by the through bore defining wall of the cylinder head, and wherein the cylinder head is formed with a port, within the through bore defining wall of the cylinder head, which overlaps said circumferential groove during the reciprocal motion of said lifter body.

23. A valve lifter as claimed in claim 20, wherein said lifter body is formed with an internal passage having two ports opening to said pair of pressure chamber means, respectively, for supply of hydraulic fluid to and discharge of hydraulic fluid from said pair of pressure chamber means.

24. A valve lifter as claimed in claim 23, wherein said lifter body is formed with a peripheral port communicating with said passage, said peripheral port being arranged within an area such that, during the reciprocal motion of said lifter body, said area is covered by the through bore defining wall of the cylinder head, and wherein the cylinder head is formed with a port, within the through bore defining wall of the cylinder head, which overlaps said peripheral port of said lifter body during the reciprocal motion of said lifter body.

25. A valve lifter as claimed in claim 20, wherein said pair of slides cooperate with each other to define thereon said second surface, said second surface being curved cylindrically in a direction of movement of the second cam.

* * * * *